US009897263B2

(12) United States Patent
Dahlen et al.

(10) Patent No.: US 9,897,263 B2
(45) Date of Patent: Feb. 20, 2018

(54) LIGHT PANEL FOR A LUMINAIRE

(71) Applicant: KENALL MANUFACTURING COMPANY, Kenosha, WI (US)

(72) Inventors: Kevin Dahlen, Lindenhurst, IL (US); Nathan Daniel Heiking, Pleasant Prairie, WI (US); Filemon Salas, Woodstock, IL (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 100 days.

(21) Appl. No.: 15/045,827

(22) Filed: Feb. 17, 2016

(65) Prior Publication Data

US 2017/0234490 A1 Aug. 17, 2017

(51) Int. Cl.

| | |
|---|---|
| ***F21V 29/00*** | (2015.01) |
| ***F21V 17/10*** | (2006.01) |
| ***F21K 9/20*** | (2016.01) |
| ***F21V 23/00*** | (2015.01) |
| ***F21V 29/76*** | (2015.01) |
| ***F21V 3/00*** | (2015.01) |
| ***F21V 29/71*** | (2015.01) |
| *F21Y 115/10* | (2016.01) |

(52) U.S. Cl.

CPC ..... *F21K 9/20* (2016.08); *F21V 3/00* (2013.01); *F21V 17/107* (2013.01); *F21V 23/005* (2013.01); *F21V 29/713* (2015.01); *F21V 29/717* (2015.01); *F21V 29/76* (2015.01); *F21Y 2115/10* (2016.08)

(58) Field of Classification Search

CPC ..... F21V 29/76; F21V 29/71; F21V 29/713; F21V 29/717; F21V 3/00; F21V 23/005; F21V 17/107; F21K 9/20

See application file for complete search history.

(56) References Cited

U.S. PATENT DOCUMENTS 5,329,436 A * 7/1994 Chiu ..... F21V 29/004 165/185
7,114,837 B2 * 10/2006 Yagi ..... F21S 48/1159 362/249.04

(Continued)

OTHER PUBLICATIONS

"Meeting the Complexities of Tunnel Lighting Head On", Application Case Study: Lighting Challenge 133, Kenall Manufacturing (2015).

(Continued)

*Primary Examiner* — Alan Cariaso
(74) *Attorney, Agent, or Firm* — Marshall, Gerstein & Borun LLP; Randall G. Rueth

(57) ABSTRACT

A light panel for a luminaire includes a frame, a lamp assembly carried by the frame, a dissipater heat sink carried by the frame, and a heat transfer line that thermally couples the lamp assembly to the dissipater heat sink. The heat transfer line transfers heat generated by the lamp assembly, for example by a light element of the lamp assembly, to the dissipater heat sink by conduction. The dissipater heat sink is exposed to an exterior side of the frame such that heat from the lamp assembly is dissipated to the exterior side of the frame by conduction through the heat transfer line and the dissipater heat sink. The light panel may form a door for a housing of a luminaire, which may be easily retrofitted to the housing.

25 Claims, 7 Drawing Sheets

(56) References Cited

U.S. PATENT DOCUMENTS

| | | | | |
|---|---|---|---|---|
| 7,641,363 | B1 * | 1/2010 | Chang | F21V 29/004 362/294 |
| 9,182,096 | B2 * | 11/2015 | Kinnune | F21V 3/0463 |
| 2009/0059594 | A1 * | 3/2009 | Lin | F21K 9/00 362/294 |
| 2011/0085339 | A1 * | 4/2011 | Lin | F21V 29/006 362/294 |
| 2011/0199771 | A1 * | 8/2011 | Luu | F21S 8/08 362/294 |
| 2012/0127738 | A1 * | 5/2012 | DeKalb | F21V 29/004 362/373 |
| 2015/0159852 | A1 | 6/2015 | Dahlen et al. | |

OTHER PUBLICATIONS

LUXTRAN™ Luminaires for Transportation Applications, CFT & WFT Series, Installation Instructions, Kenall Manufacturing (Mar. 27, 2013).
LUXTRAN™ CFT1228 Series Product Brochure (Apr. 7, 2016).

* cited by examiner

LIGHT PANEL FOR A LUMINAIRE

FIELD

This application relates generally to luminaires, and, more particularly, for a light panel assembly, such as a door panel, for a luminaire.

BACKGROUND

A luminaire is generally understood to include one or more light producing subsystems carried by a housing along with power, driving, and/or power distribution devices. In this manner, the luminaire provides a single unit that is easy to install and/or ship. An example of a luminaire is a light fixture, such as a hanging light fixture commonly installed to hang from a ceiling or wall. However, there are many different types of luminaires, and the luminaires discussed herein are to be considered representative of all such devices.

In the past, luminaires used to provide relatively high levels of light for relatively large areas, such as outdoors, along driving surfaces such as parking lots, roadways, and tunnels, as well as in industrial areas and warehouses, have often had high-intensity discharge (HID) lamps as the primary light source. HID lamps, in general, are based on passing an electric arc between two spaced apart electrodes within a transparent or translucent arc-tube filled with a gas and/or salts that form intense plasma light when excited by the electric arc. Various examples of such HID lamps include mercury-vapor lamps, metal-halide lamps, ceramic metal-halide lamps, sodium vapor lamps, and xenon lamps.

Today, the use of light emitting diode (LED) based lighting systems for luminaires is becoming increasingly commonplace due to their energy efficiency and life span in comparison to other types of light sources, including many common HID lamps. Because of the potential long term energy and cost savings, it is often desired to replace existing installed HID lamps with LED lights.

When the HID lamp is disposed within and/or carried by a housing of a luminaire, this change out could be accomplished by replacing the entire HID luminaire with a new LED luminaire. For customers that have very large numbers of luminaires, however, the up-front cost of such a change-over can be extremely high.

In order to save costs and re-use existing hardware, it may be possible to retrofit an HID-based luminaire with an LED lamp. Such a retrofit can include removing the HID lamp and associated driving equipment from the luminaire housing and replacing it with an LED lamp assembly and associated driving equipment, thereby re-using the existing luminaire housing and support structures. However, such a change out of the lighting system is often very labor intensive. In addition, the difference in heat production and dissipation mechanisms between an HID-based luminaire and an LED-based luminaire can raise additional difficulties when attempting to retrofit an HID luminaire with an LED lamp assembly. This difficulty arises primarily from the fact that HID lamps generally rely on radiation from the reflector to expel the heat out of the luminaire, whereas LED lamp assemblies often rely on conduction to expel heat from the luminaire. Thus, the difference in heat dissipation mechanisms can also make it more complex to retrofit an LED lamp assembly into the housing of an HID-based luminaire.

SUMMARY

According to some aspects of the disclosure, a light panel for a luminaire includes a frame, a lamp assembly carried by the frame, a dissipater heat sink carried by the frame, and a heat transfer line that thermally couples the lamp assembly to the dissipater heat sink. The heat transfer line transfers heat generated by the lamp assembly, for example by a light element of the lamp assembly, to the dissipater heat sink by conduction. The dissipater heat sink is exposed to an exterior side of the frame such that heat from the lamp assembly is dissipated to the exterior side of the frame by conduction through the heat transfer line and the dissipater heat sink.

According to some aspects of the disclosure, the light panel may be in the form of a door, such as a replacement door, for a luminaire. The door may include a door frame, an LED light board carried by the door frame, a dissipater heat sink carried by the door frame, and a heat transfer line that thermally connects the LED light board to the dissipater heat sink. The dissipater heat sink is exposed to an exterior side of the door frame, and the heat transfer line transfers heat generated by the LED light board to the dissipater heat sink. In this manner, heat from the LED light board is dissipated to the exterior side of the frame by conduction through the heat transfer line and the dissipater heat sink.

According to some aspects of the disclosure, a method of retrofitting a luminaire is provided. The luminaire may include a housing defining an interior and an opening into the interior. An existing lamp assembly may be removed from the housing. One or more of the light panel and the replacement door described herein may be coupled to the housing, arranged to cover the opening and project light to an exterior of the housing. The existing lamp assembly may include an HID lamp.

The apparatus and method disclosed herein, in some arrangements, may provide an easier and faster way to retrofit a luminaire having an existing lamp assembly, such as an HID lamp assembly, with a new lamp assembly, such as and LED lamp assembly. Additional aspects, arrangements, features, and/or technical effects will become apparent upon detailed inspection of the figures and the detailed description.

DETAILED DESCRIPTION

Figure 1:
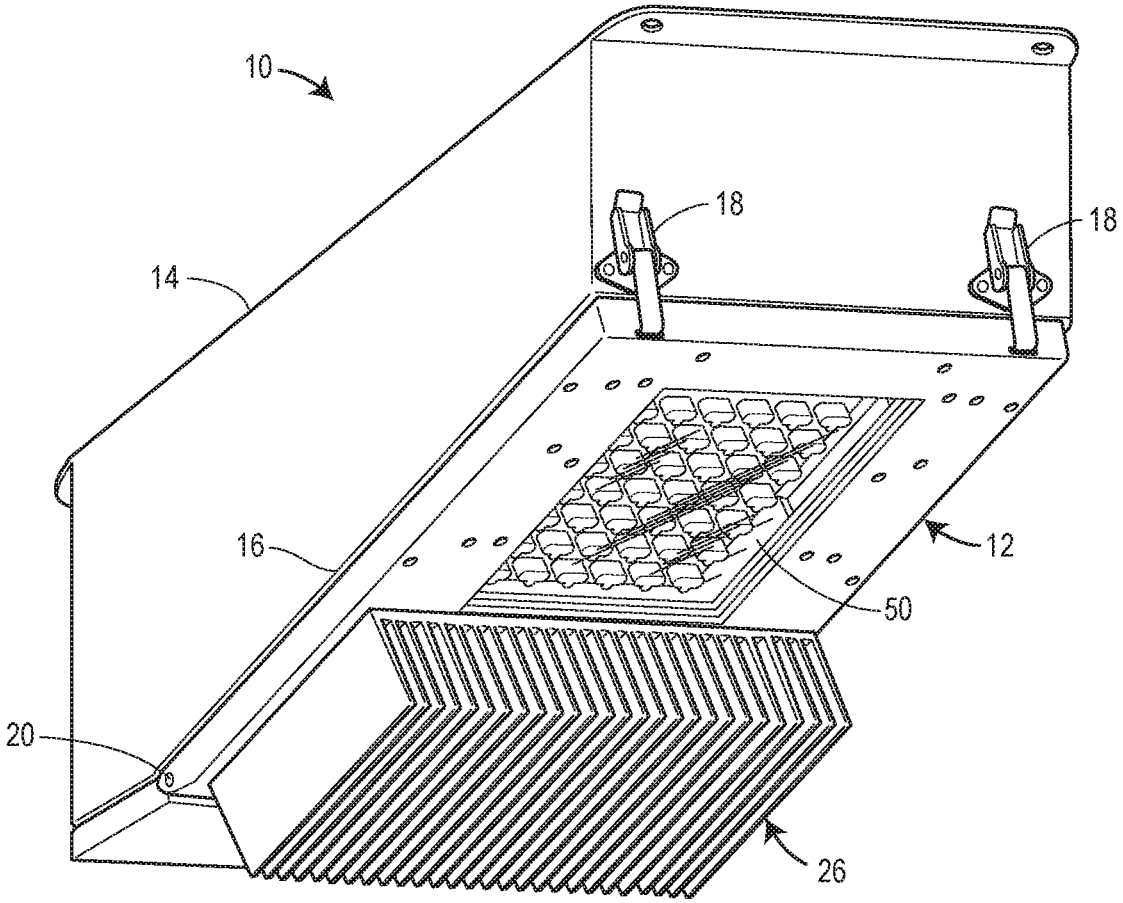
FIG. 1 is an isometric view of a luminaire with a light panel operatively installed on a housing according to some aspects of the present disclosure.
Figure 2:
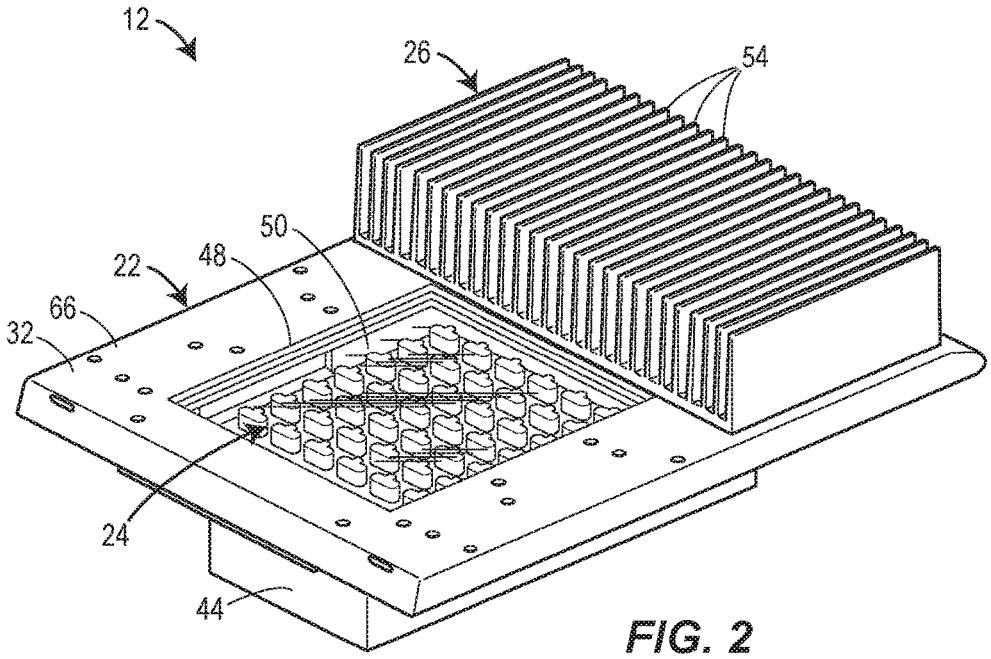
FIG. 2 is an isometric view of a front side of the light panel of FIG. 1 in a fully assembled condition.

Before describing the specific examples of the drawings, some general aspects, arrangements, and features of the disclosed luminary light panel assembly, and/or luminaires are provided.

In some arrangements, a light panel for a luminaire includes a frame having an exterior side and an interior side opposite the exterior side. A lamp assembly is carried by the frame. The lamp assembly may include a light element arranged to project light toward the exterior side of the frame. A dissipater heat sink is carried by the frame. The dissipater heat sink may be spaced apart from the lamp assembly. The dissipater heat sink is exposed to the exterior side of the frame. At least one heat transfer line thermally couples the lamp assembly to the dissipater heat sink. The heat transfer line transfers heat generated by the light element to the dissipater heat sink by conduction. In this manner, heat from the light element is dissipated to the exterior side of the frame by conduction through the heat transfer line and the dissipater heat sink.

The heat transfer line may have the form of an elongate member made of metal or other highly thermally conductive material. For example, the heat transfer line may be a wire, a rod, a tube, and/or a pipe. The heat transfer line may be made of aluminum.

The lamp assembly may include an LED light board. The LED light board may have a circuit board. The light element may include a light emitting diode (LED) coupled to the circuit board. A secondary optic may be arranged to focus light from the LED toward the exterior side of the frame. The LED light board may be disposed on the interior side of the frame.

The dissipater heat sink may include a first section and a second section coupled to the first section. A first portion of the heat transfer line may be sandwiched between the first section and the second section. The dissipater heat sink may include cooling fins. The cooling fins may be disposed on the exterior side of the frame.

The frame may include a mount to attach the frame to a luminaire housing. The mount may be a hinge, and the frame may form a door frame. Thus, the light panel may form a replacement door or other replacement panel for a luminaire.

An accumulator heat sink optionally may be coupled to the lamp assembly so as to collect heat from the light element. The accumulator heat sink may be spaced apart from the dissipater heat sink. The heat transfer line may be thermally coupled to the accumulator sink and may be thermally coupled to the dissipater heat sink. The accumulator heat sink may have a first section and a second section coupled to the first section. A second portion of the heat transfer line may be sandwiched between the first section and the second section of the accumulator heat sink. A bracket may be provided to hold the accumulator heat sink against the lamp assembly and/or to hold the lamp assembly in a fixed position relative to the frame, for example, via a coupling to the accumulator heat sink. Thus, the bracket can help maintain the lamp assembly in a preferred fixed position to emit light outwardly from the light panel.

The frame may include an outer frame and an inner frame coupled to the outer frame. The outer frame, and optionally the inner frame, may have a first opening. A window may be captured between the outer frame and the inner frame to cover the first opening. The light element may shine through the window and the first opening.

The outer frame, and optionally the inner frame, may have a second opening. The dissipater heat sink may extend through the second opening. The dissipater heat sink may include a dissipater cap connected to heat fins. The dissipater cap may be captured between the inner frame and the outer frame. The heat fins may be disposed on the exterior side of the frame.

The frame may be formed of a first metal, such as a highly wear-resistant metal, and the dissipater heat sink, the accumulator heat sink, and/or the heat transfer tubes may be formed of a second metal, such as a highly heat conductive metal. For example, the first metal may be stainless steel and/or the second metal may be aluminum. However, other metals and/or other non-metallic materials could be used. A sealing element may be provided that electrically isolates the dissipater heat sink from the frame, which may prevent or reduce undesirable electro-chemical reactions therebetween, such as galvanic reactions.

In some arrangements, a replacement door for a luminaire, includes a door frame having an interior side and an exterior side and a hinge for mounting to a housing of the luminaire, an LED light board carried by the door frame and disposed on the interior side of the door frame, a dissipater heat sink carried by the door frame, the LED light board arranged to project light toward the exterior side of the door frame, and a heat transfer line thermally coupling the LED light board to the dissipater heat sink. The dissipater heat sink is spaced apart from the LED light board and exposed to the exterior side of the door frame. The heat transfer line transfers heat generated by the LED light board to the dissipater heat sink. In this manner, heat from the LED light board is dissipated to the exterior side of the frame by conduction through the heat transfer line and the dissipater heat sink.

An accumulator heat sink may be coupled to a back side of the LED light board and arranged to collect heat generated by LEDs on the LED light board via conduction. The accumulator heat sink may be spaced apart from the dissipater heat sink. A first end of the heat transfer line may be coupled to the accumulator sink, and a second end of the heat transfer line may be coupled to the dissipater heat sink.

An electric power driver may be operatively coupled to the LED light board to power the LED light board. The power driver may be carried by the door frame, either attached directly to the frame or indirectly to the frame via one or more intermediate structures, and disposed on the interior side of the door frame.

The dissipater heat sink may have heat fins disposed on an exterior side of the door frame and a dissipater cap. The heat transfer line may be attached to the dissipater cap.

The door frame may have a first opening and a window covering the first opening. The LED light board may project light through the window. The window may include or form a diffuser and/or a lens. The window may form a tertiary optic.

While specific exemplary forms are illustrated and described herein, is to be understood that any of the various aspects, arrangements, and/or features disclosed herein may be combined with any one or more of the other aspects, arrangements, and/or features disclosed herein.

Turning now to the exemplary arrangements of the drawings, FIG. 1 illustrates a luminaire 10 that includes a light panel 12 exemplifying some aspects of the present disclosure and a housing 14 that carries the light panel 12. The housing 14 defines interior space (not visible) suitable for receiving various components of the light panel 12, such as a power driver, reflector, and light element. The housing 14 is also suitable for mounting to a support surface, such as a wall, ceiling, hanger, etc., and includes an opening 16 into the interior space. In this arrangement, the housing 14 is in the form of generally rectangular metal box, made of stainless steel for example; however, the housing 14 may take other forms suitable for carrying and receiving the light panel 12 and mounting the light panel 12 to a support surface.

The light panel 12 is mounted to the housing 14 by one or more couplers 18. The couplers 18 may include, for example, hinges, latches, slots, straps, fasteners, hangers, or other couplings, and/or various combinations thereof. Preferably, the couplers 18 releasably couple the light panel 12 to the housing 14 so as to cover the opening 16 in an operative position. The light panel 12 may partially or completely seal the opening 16 against ingress of dirt and/or water through the opening 16 into the interior of the housing.

The light panel 12 may have different shapes, sizes, and/or forms depending on the specific requirements of a given luminaire. In the present example, the light panel 12 is in the form of a door for the luminaire 10 and includes one or more hinges 20 that pivotably couple to the housing 14 such that the light panel 12 can be pivoted about the hinges 20 to open and/or close the opening 16. Further, the couplers 18 in this example include cam latches that releasably latch the light panel in a closed position covering the opening 16. However, in other forms, the light panel 12 may simply form a sidewall, or portion of a sidewall of a luminaire or some other type of panel that is part of a luminaire.

The light panel 12 in the form of a door may be, for example, a replacement door for the luminaire 10. For example, the luminaire 10 may have originally carried and contained an HID lamp assembly, including an HID lamp, an electric power driver and control electronics, and a reflector within the housing 14. The HID lamp assembly may be removed from the housing 14, and replaced with the light panel 12 by connecting the hinges 20 to the housing 14. Appropriate electrical connections would also be made to provide appropriate power to the light panel 12. The light panel 12 can then be secured in the closed position over the opening 16 by latching the couplers 18. In this manner, the light panel 12, when including an LED lighting system as described hereinafter, provides for a relatively simple and fast way to convert an HID-based luminaire into an LED-based luminaire.

FIGS. 2-8 show the light panel 12 separately from remaining portions of the luminaire 10 in various views as described previously for improved visibility. The light panel 12 includes a frame 22, a lamp assembly 24 carried by the frame 22, a dissipater heat sink 26 carried by the frame 20, and at least one heat transfer line 28 that thermally couples the lamp assembly 24 to the dissipater heat sink 26. The lamp assembly 22 includes one or more light elements 30 (see FIG. 9) arranged to project light outwardly toward an exterior side 32 of the frame 22 and from the luminaire 10 when operatively coupled thereto. The heat transfer line 28 transfers heat generated by the lamp assembly 24 to the dissipater heat sink 26, which is exposed to the outside environment on the exterior side 32 of the frame. In this manner, heat from the light element(s) is dissipated to the outside environment on the exterior side of the frame 22 by conduction through the heat transfer line(s) 28 and the dissipater heat sink 26.

The frame 22 itself has the exterior side 32 and an interior side 34. In this arrangement, the frame 22 has the shape of a generally flat plate such that the exterior side 32 and the interior side 34 are opposite sides of the generally flat plate. When the light panel 12 is operatively mounted on the housing 14 as illustrated in FIG. 1, the interior side 34 faces the interior of the housing 14, and the exterior side 32 faces outwardly from the housing. Thus, the exterior side 32, if not covered by another object, forms an exterior surface of the luminary 10 when operatively mounted on the housing 14. However, the frame 22 is not limited to a generally flat plate, but may have other shapes as appropriate to cover an opening in the housing 14 of a luminaire with an exterior side and an interior side and to conform to the specific shape of the housing 14.

Figure 9:
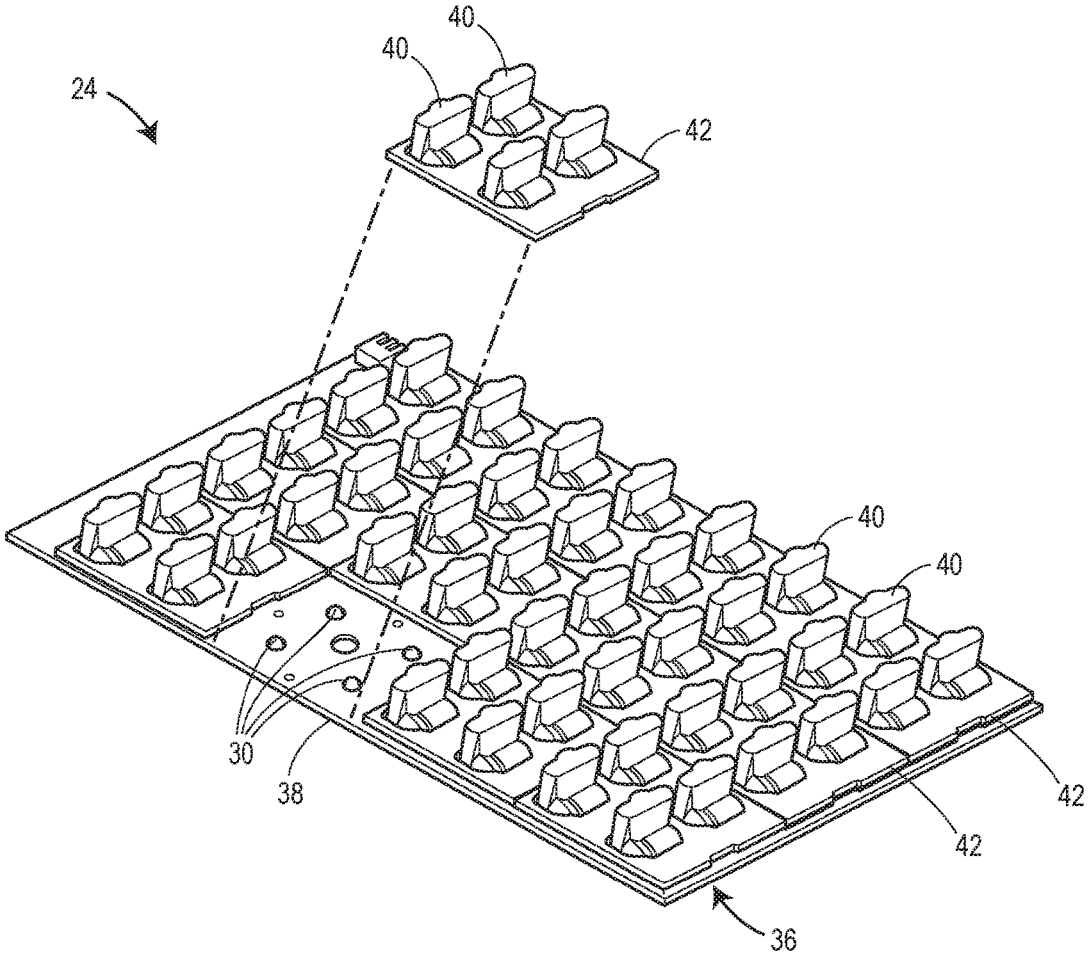
FIG. 9 is an enlarged isometric view of a lamp assembly of the light panel, shown in isolation for clarity.

As best seen in FIG. 9, the lamp assembly 22 in this example is an LED lamp assembly including an LED light board 36. The LED light board 36 includes a circuit board 38, and the light elements 30 are LEDs (light emitting diodes) operatively disposed on the circuit board 38 to produce light. The LED light board 36 may include primary optics covering the LEDS, as is common for LED light boards. The lamp assembly 22 optionally includes one or more secondary optics 40 disposed over the primary optics for providing additional focusing and/or directional control of the light emitted by the LEDs. The secondary optic 40 may have, for example, a collimator lens and/or a light pipe that provides a selected direction and/or focus of the light outward toward a desired illumination surface, such as a parking lot, street, floor, or working area. Optionally, the secondary optics 40 may be grouped in one or more optic panels 42, wherein each optic panel 42 includes one or more of the secondary optics 40. One exemplary secondary optic 40 that may be suitable for use in some circumstances is described in co-pending U.S. patent application Ser. No. 14/850,290, filed on Sep. 10, 2015, the complete disclosure of which is incorporated by reference herein. However, other secondary optics 40 may also be used if desired. Further, other types of lamp assemblies may be used, which may include other types of lamps, and the disclosure is not necessarily limited to LED lamps or LED lighting systems.

Optionally, a driver box 44 is also carried by the frame 22 so as to form a unitary part of the light panel 12. The driver box 44 includes a driver housing and one or more electrical power drivers (not visible) disposed inside the driver housing operatively arranged to control and/or provide electrical power to light the light elements 30 on the circuit board 38. The driver box 44 may be coupled directly to the frame 22 or indirectly to the frame 22. In the illustrated example, the driver box 44 is coupled indirectly to the frame 22. The driver box is attached to a housing 46, which is in turn attached to the frame 22. However, other coupling arrangements are also contemplated, depending on the specific space and shape requirements of a given luminaire.

In the present arrangement, the entire lamp assembly 24 is disposed on the interior side of the frame 22, and the light elements 30 direct light through a first opening 48 in the frame so that the light shines through the frame 22 to the exterior side 32. Optionally, a window 50 covers the first opening 48 to allow the light to travel through the frame 22 while protecting the lamp assembly 24 from the outside elements. The window 50 may form a tertiary optic, such as a diffuser, lens, or collimator, or may simply provide a transparent barrier. Preferably, a seal 52 disposed between the window 50 and the frame 22 extends completely around the first opening 48 to keep dirt and/or water from passing through the first opening 48 from the exterior side 32 to the interior side 34.

The dissipater heat sink 26 is spaced apart from the lamp assembly 24 so as not to contact the lamp assembly 24 and thereby form a thermal barrier in the form of an air gap between the lamp assembly 24 and the dissipater heat sink 26. The dissipater heat sink 26 is exposed directly to the atmosphere on the exterior side 32 of the frame 22. Thus, heat radiated from the dissipater heat sink 26 is dissipated to the environment on the exterior side 32 of the frame 22 such that, when the light panel 12 is operatively mounted to the housing 14, the heat is dissipated to the external environment surrounding the luminaire 10. In the illustrated arrangement, the dissipater heat sink 26 includes a set of heat fins 54 disposed on the exterior side 32 of the frame 22. The heat fins 54 are in the form of a series of parallel, spaced apart fins, which may be made of a highly heat conductive metal, such as aluminum. The dissipater heat sink 26 also includes a dissipater cap 56 that couples the dissipater to the heat transfer lines 28. The dissipater cap 56 is made of a thermally conductive material, such as aluminum, so as to thermally couple the heat transfer lines 28 to the heat fins 54. The dissipater cap 56 includes a first section 56*a* and a second section 56*b* coupled to the first section. The first and second sections 56*a*, 56*b* sandwich, such as by clamping, a portion of the heat transfer lines 28 therebetween. In the exemplary arrangement, the first section 56*a* forms an upper plate and the second section 56*b* forms a lower plate that are attached to the heat fins 54, for example, by one or more screws or other fasteners. Preferably, the upper and lower sections 56*a* and 56*b* form recesses that receive and clamp the heat transfer lines 28 therebetween, thereby physically connecting the heat transfer lines 28 to the dissipater heat sink 26. In this arrangement, each of the first and second sections 56*a* and 56*b* is generally flat with opposing half-cylindrical recesses that receive ends of heat transfer lines 28. However, the dissipater heat sink 26 need not be limited to the exact form of this example. For example, in some arrangements the dissipater cap 56 may have a different shape and/or may have different connection mechanisms for coupling to the heat transfer lines 28. Or, the dissipater cap 56 in some arrangements may be omitted altogether, and the heat transfer lines 28 could connect directly to the heat fins 54. Further, the heat fins 54 may have different shapes and/or sizes and/or arrangements. The main point is that the dissipater heat sink 26 have a form suitable for thermally coupling to the heat transfer lines 28 and dissipating by radiation heat conducted thereto to the exterior side of the frame 22, and thus away from the interior of the luminaire 10 when assembled thereon.

The heat transfer lines 28 thermally connect the lamp assembly 24 to the dissipater heat sink 26 so as to transfer by conduction heat generated by the light elements 30 of the lamp assembly 24 to the dissipater heat sink 26. In this example, each heat transfer line 28 is an elongate tube made of a heat conductive material, such as aluminum, and preferably having opposite first and second ends 58*a* and 58*b*. The first end 58*a* of each heat transfer line 28 is thermally coupled with the lamp assembly 24 to collect heat generated by the light elements 30. The second end 58*b* of each heat transfer line 28 is thermally coupled with the dissipater heat sink 26, for example by being clamped between the first and second sections 56*a* and 56*b* (e.g., upper and lower plates) as described previously herein. However, the heat transfer lines may take other elongate forms suitable for thermally connecting the dissipater heat sink 26 with the lamp assembly 24 to conduct the generated heat to the dissipater heat sink 26, such as rods, wires, ribbons, bars, etc.

The first end 58*a* of each heat transfer line 28 may be thermally coupled with the lamp assembly 24 either directly or indirectly. In the illustrated example, the first ends 58*a* of the heat transfer lines 28 are indirectly thermally coupled with the lamp assembly 24 by an accumulator heat sink 60. The accumulator heat sink 60 is attached to a rear side of the lamp assembly 24 and is made of a heat conductive metal, such as aluminum, so as to collect the heat from the lamp assembly 24 by conduction. The accumulator heat sink 60 is connected to the first ends 58*a* of the heat transfer lines 28. Preferably, the accumulator heat sink 60 is thermally isolated from the dissipater heat sink 26, such by being spaced apart from each other with an air gap in between. The accumulator heat sink 60 in the illustrated example is generally similar to the dissipater cap 56, having a first section 60*a* coupled to a second section 60*b* that sandwich a portion of the heat transfer lines 28 therebetween. Also similar to the dissipater cap 56, the first section 60*a* may form of an upper plate, and the second section 60*b* may form a lower plate that, together, clamp the heat transfer lines 28 therebetween. Each of the first and second sections 60*a* and 60*b* is generally flat with opposing half-cylindrical recesses that receive the first ends 58*a* of the heat transfer lines 28 therein. Like the dissipater cap 56, the accumulator heat sink 60 is not necessarily limited to this shape and form, and may take other shapes and forms suitable for thermally connecting the lamp assembly 24 to the heat transfer lines 28. In other arrangements, the first ends 58*a* of the heat transfer lines 28 may be directly thermally coupled with the lamp assembly 24, for example by having a heat transfer line 28 attached directly to or close enough to a light element 30 of the lamp assembly 24 so as to draw the heat directly from the light element 30.

Preferably, although not necessarily, the light panel 12 provides all of the major components necessary for the light producing functions of the luminaire 10 together as a single unit. This provides the benefit of allowing the light panel 12 to be quickly and easily installed in the housing 14 of the luminaire 10, either as original equipment or as retrofitted replacement equipment. Following are some additional details of the light panel 12 that may optionally be provided in order to provide additional benefits and/or useful features.

Figure 3:
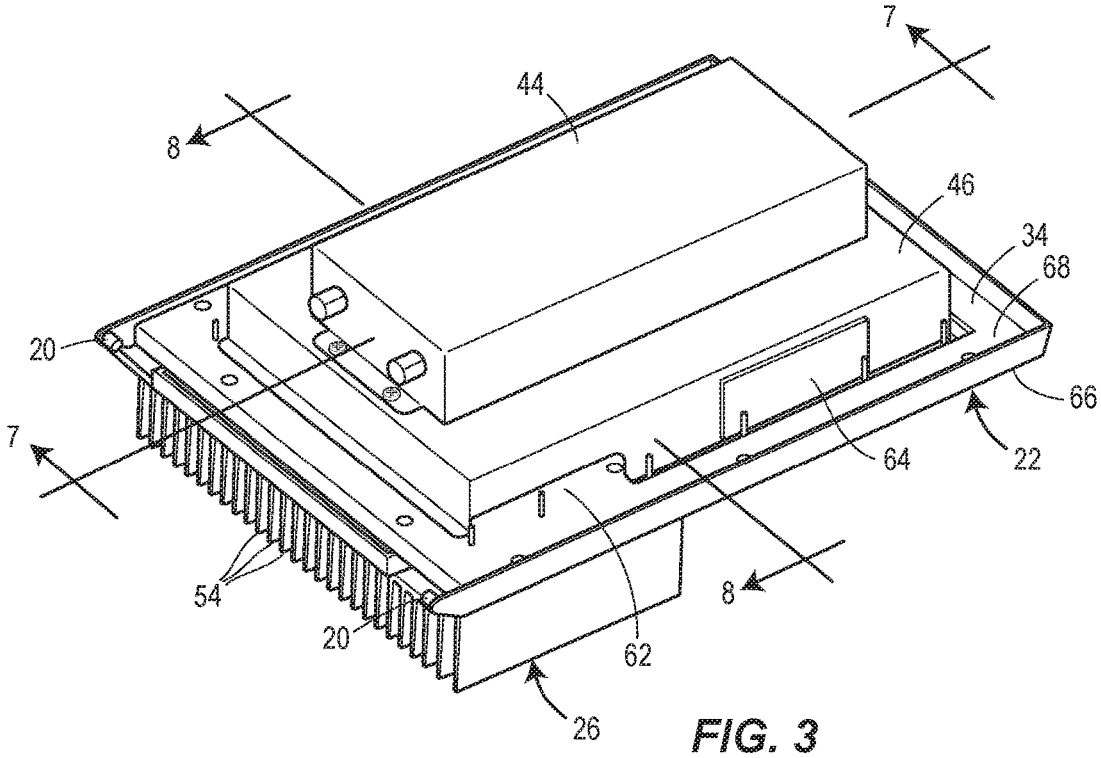
FIG. 3 is an isometric view of a rear side of the light panel in the fully assembled condition.
Figure 4:
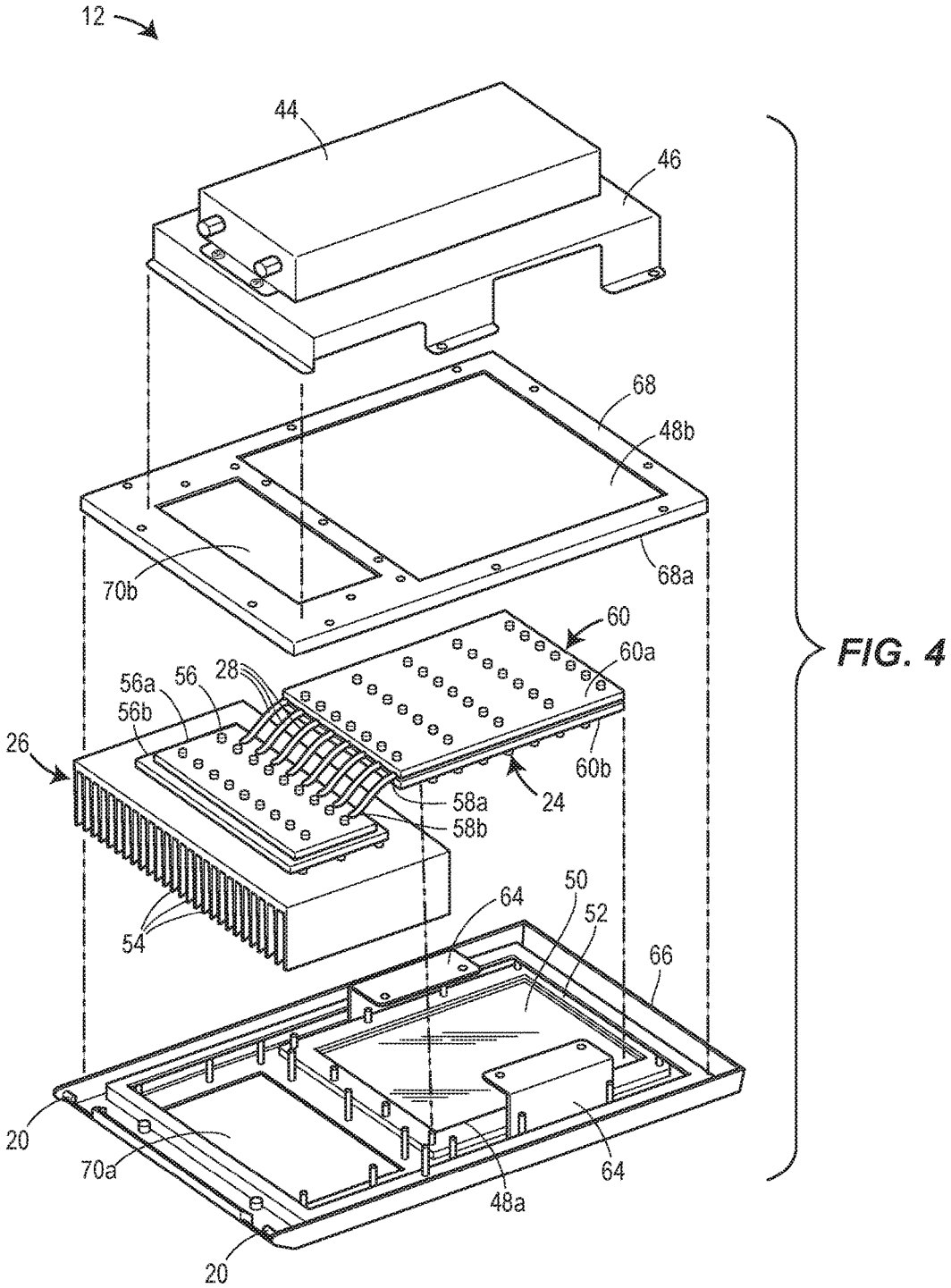
FIG. 4 is an exploded isometric view of the light panel.
Figure 5:
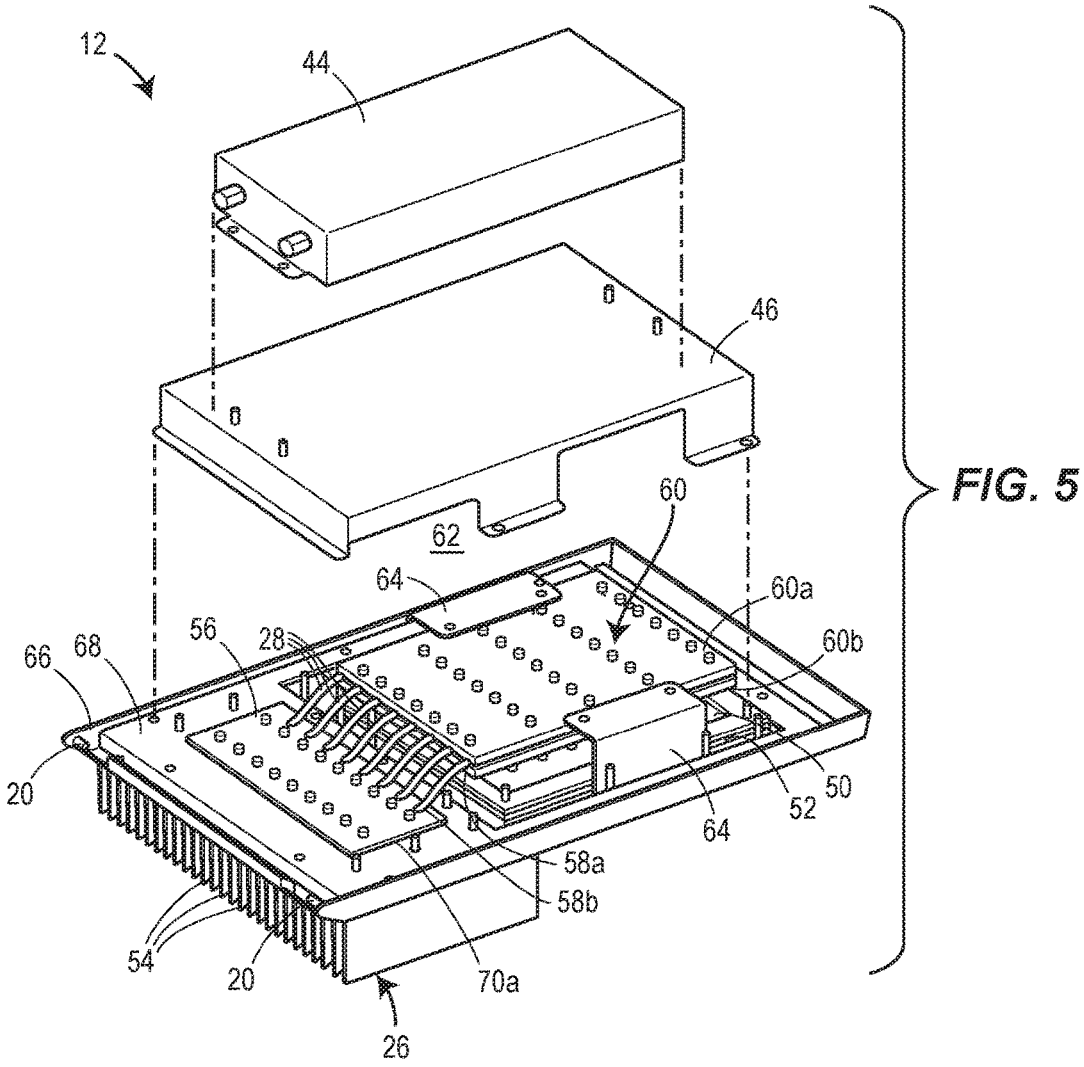
FIG. 5 is a partially exploded isometric view of the light panel from the rear side.
Figure 6:
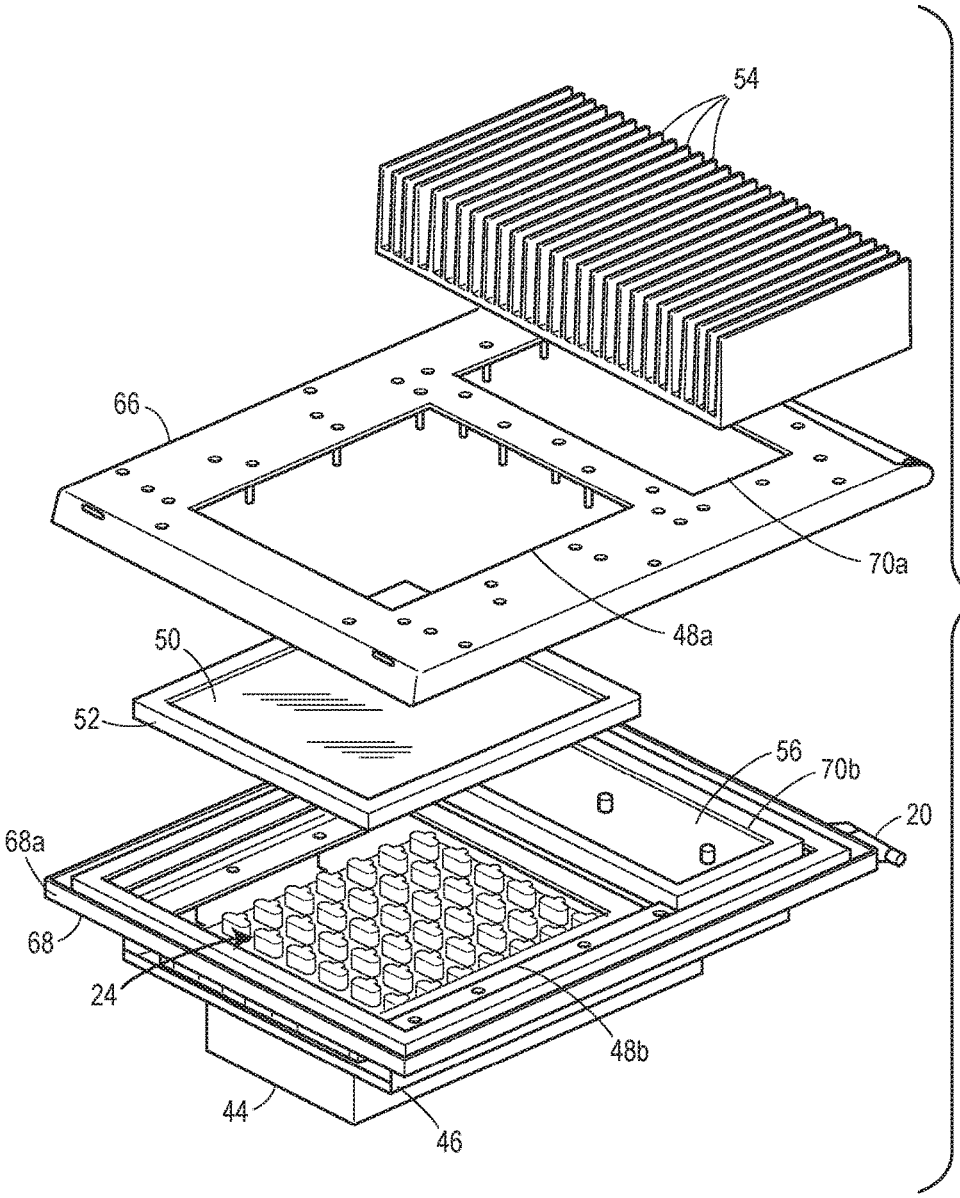
FIG. 6 is a partially exploded isometric view of the light panel from the front side.

As best seen in FIGS. 3-5, on the rear side of the light panel 12, which corresponds with the interior side 34 of the frame 22, the housing 46 may be attached to the interior side 34 of the frame 22. The housing 46 substantially covers the rear sides of the dissipater heat sink 26 and the accumulator heat sink 60 and the heat transfer lines 28. The housing 46 optionally includes one or more openings 62, which may allow heat from the lamp assembly 24, the dissipater cap 56, the accumulator heat sink 60, and/or the heat transfer lines 28 to escape by radiation and thereby provide additional cooling for the light panel 12. The driver box 44 is attached to the housing 46, for example, with screws or bolts. Thus, when assembled, the rear side of the light panel 12 provides a relatively clean shape and form that is easy to handle and install as a unit, for example, into the housing 14 of the luminaire 10.

Figure 7:
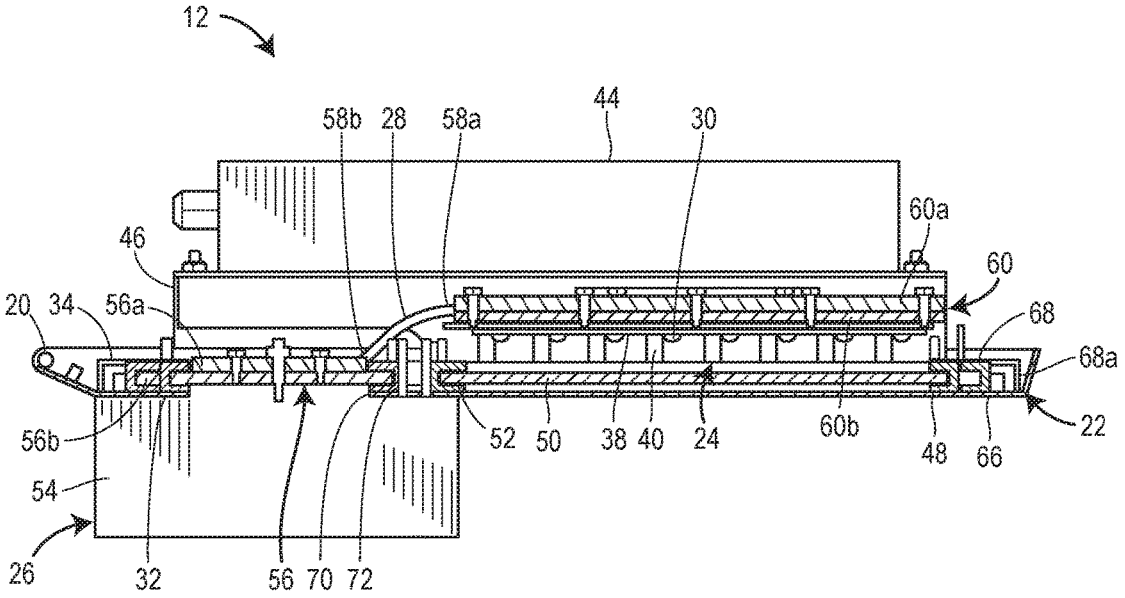
FIG. 7 is a cross-sectional view of the light panel along the lines 7-7 shown in FIG. 3.

As best seen in FIGS. 4 and 5, one or more brackets 64 may be provided that hold the accumulator heat sink 60 against the rear of the lamp assembly 24. The brackets 64 can help maintain a continuous and/or continual contact to enable conductive heat transfer from the lamp assembly 24 to the accumulator heat sink 60. The brackets 64 can help maintain the lamp assembly 24 in a selected position relative to the frame 22 with the light elements 30 on the front side of the lamp assembly 24 arranged to project light through the first opening 48 and the window 50 toward the exterior side 32 of the frame 22. In some arrangements, other mechanisms, such as screws or welds, may be additionally or alternatively provided to fasten the accumulator heat sink 60 against the lamp assembly 24. Each bracket 64 is attached to the frame 22 at one location and is attached to the accumulator heat sink 60 at another location so as to clamp and/or hold the accumulator heat sink 60 against the lamp assembly 24, such as against the rear side of the circuit board 38, and in a fixed position relative to the frame 22. As best seen in FIG. 7, the lamp assembly 24 may be attached to the front side of the accumulator heat sink 60, for example, with screws, clips, welds, or other appropriate fasteners. Thus, in this example, the brackets 64 provide the primary mechanism for holding the accumulator heat sink 60 and the lamp assembly 24 in the operative position with the light elements 30 shining outwardly through the window 50. In the illustrated example, there are two brackets 64 disposed on opposite sides of the accumulator heat sink 60; however, more or fewer and different arrangements of such brackets are also contemplated.

The frame 22 may also include one or more optional features that can provide additional technical benefits. For example, in the illustrated example as best seen in FIGS. 4 and 6-8, the frame 22 is formed of two sections, an outer frame 66 and an inner frame 68. The outer frame 66 has a plate section that forms the surface disposed on the exterior side 32 of the frame and faces the exterior of the luminaire 10 when operatively mounted. The inner frame 68 has a plate section that is generally the same size and shape as the plate section of the outer frame 22*a* and forms the surface that is disposed on the interior side 34 of the frame 22. Optionally, the inner frame 68 has a slightly smaller outer periphery than the outer frame 66 and includes a peripheral sidewall 68*a* extending around the outer periphery of the plate section. When the inner frame 68 is operatively coupled to the outer frame 66, the plate sections face and oppose one another substantially parallel with each other, and the peripheral sidewall 68*a* acts as a spacer to maintain a gap between the opposing plate sections. Both the inner frame 68 and the outer frame 66 have congruent first openings 48*a* and 48*b* that together define the first opening 48 through the frame 22. Further the frame 22 has a second opening 70, defined by congruent second openings 70*a* and 70*b* in both the inner and outer frame 68 and 66, through which the dissipater cap 56 extends to couple to the heat fins 54. The window 50 is clamped between the inner frame 68 and the outer frame 66 across the first opening 48. The dissipater cap 56 is clamped between the inner frame 68 and the outer frame 66 across the second opening 70.

Figure 8:
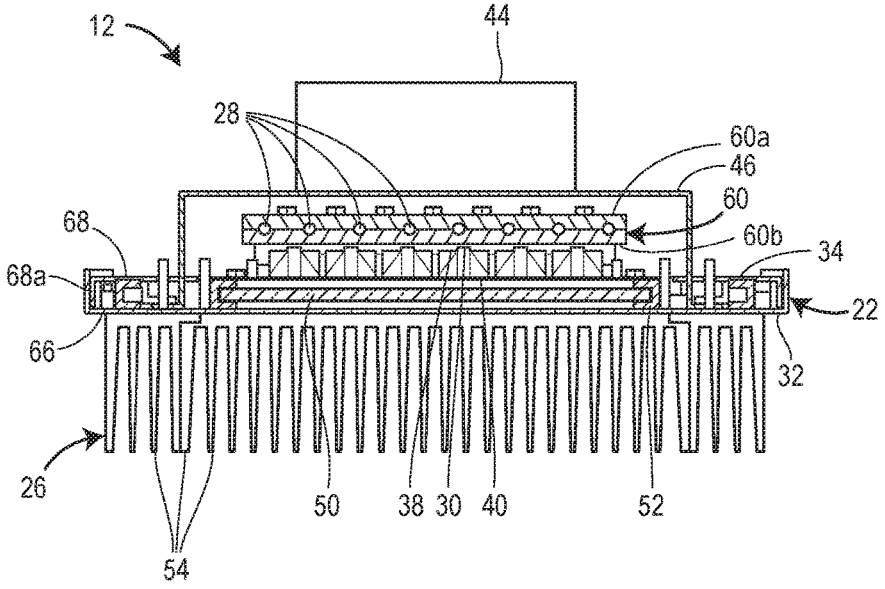
FIG. 8 is a cross-sectional view of the light panel along the lines 8-8 shown in FIG. 3.

The seal 52 may be provided that extends around the outer periphery of the window 50 and forms a peripheral seal between the window and each of the inner frame 68 and the outer frame 66, thereby preferably forming a water tight peripheral barrier to prevent ingress of water and dirt through the first opening 48 around the window 50. A second seal 72 may be provided that extends around the outer periphery of the dissipater cap 56 and forms a peripheral seal between the dissipater cap 56 and each of the inner frame 68 and the outer frame 66, thereby preferably forming a water tight peripheral barrier to prevent ingress of water and dirt through the second opening 70 around the dissipater cap 56. In addition, the second seal 72 may be made of an electrical insulator, such as rubber or other similarly electrically insulating material, so as to electrically isolate the dissipater cap 56, which may be made of aluminum, from the frame 22, which may be made of stainless steel, in order to prevent a galvanic reaction between the to different metals. As can be seen in FIGS. 7 and 8, each of the first seal 52 and the second seal 72 preferably has a C-shaped cross-section that forms a groove to receive the peripheral edge of the window 50 or dissipater cap 56, respectively.

The exact arrangement and shape of the inner frame 68 may be varied, however, and need not be limited to the illustrated example. In other arrangements for example, the inner frame 68 may not include the first opening 48*b* and/or second opening 70*b*, but rather may have a different shape that is arranged to hold the window 50 and/or the dissipater heat sink 26 in a desired position. Still further, in other arrangements, the frame 22 may have more, fewer, and/or different shaped and/or sized components, for example, being formed of a single piece and using different types of connectors to carry the lamp assembly 24, dissipater heat sink 26 and the heat transfer pipes 28, as well as any other components that are provided.

This detailed description is to be construed as examples only and does not describe every possible embodiment, as describing every possible embodiment would be impractical, if not impossible. One could implement numerous alternate embodiments, using either current technology or technology developed after the filing date of this application.

We claim:

1. A light panel for a luminaire, comprising:

a frame having an exterior side and an interior side opposite the exterior side;

a lamp assembly carried by the frame, the lamp assembly including a light element arranged to project light toward the exterior side of the frame;

a dissipater heat sink carried by the frame, the dissipater heat sink having a first section and a second section, the second section being coupled to the first section, wherein the dissipater heat sink is spaced apart from the lamp assembly, and wherein the dissipater heat sink is exposed to the exterior side of the frame; and a heat transfer line thermally coupling the lamp assembly to the dissipater heat sink, wherein the heat transfer line transfers heat generated by the light element to the dissipater heat sink, whereby heat from the light element is dissipated to the exterior side of the frame by conduction through the heat transfer line and the dissipater heat sink, and wherein a first portion of the heat transfer line is sandwiched between the first section and the second section.

2. The light panel of claim 1, wherein the heat transfer line comprises an elongate metallic member.

3. The light panel of claim 1, wherein the heat transfer line comprises at least one of a wire, rod, tube, and pipe.

4. The light panel of claim 1, wherein the lamp assembly comprises an LED light board including a circuit board and, the light element comprising a light emitting diode (LED) coupled to the circuit board, and a secondary optic arranged to focus light from the LED toward the exterior side of the frame, and wherein the LED light board is disposed on the interior side of the frame.

5. The light panel of claim 1, wherein the dissipater heat sink comprises:

cooling fins disposed on the exterior side of the frame.

6. The light panel of claim 1, wherein the frame comprises a mount to attach the frame to a luminaire housing.

7. The light panel of claim 6, wherein the frame comprises a door frame, and the mount comprises a hinge.

8. The light panel of claim 1, further comprising:

an accumulator heat sink coupled to the lamp assembly so as to collect heat from the light element, wherein the accumulator heat sink is spaced apart from the dissipater heat sink, and wherein the heat transfer line is thermally coupled to the accumulator sink and is thermally coupled to the dissipater heat sink.

9. The light panel of claim 8, wherein the accumulator heat sink comprises:

a first section; and a second section coupled to the first section, and wherein a second portion of the heat transfer line is sandwiched between the first section and the second section.

10. The light panel of claim 8, further comprising:

a bracket that holds the accumulator heat sink against the lamp assembly.

11. The light panel of claim 1, wherein the frame comprises:

an outer frame having a first opening and a second opening; and an inner frame coupled to the outer frame;

and further comprising:

a window captured between the outer frame and the inner frame, the window covering the first opening, wherein the light element shines through the window and the first opening, and the dissipater heat sink extends through the second opening.

12. The light panel of claim 11, wherein the dissipater heat sink comprises a dissipater cap connected to heat fins, the dissipater cap is captured between the inner frame and the outer frame, and the heat fins are disposed on the exterior side of the frame.

13. The light panel of claim 11, further comprising:

a sealing element that electrically isolates the dissipater heat sink from the frame.

14. A replacement door for a luminaire, comprising:

a door frame having an interior side and an exterior side and a hinge for mounting to a housing of the luminaire;

an LED light board carried by the door frame and disposed on the interior side of the door frame, the LED light board arranged to project light toward the exterior side of the door frame;

a dissipater heat sink carried by the door frame, wherein the dissipater heat sink is spaced apart from the LED light board, and wherein the dissipater heat sink is exposed to the exterior side of the door frame; and a heat transfer line thermally coupling the LED light board to the dissipater heat sink, wherein the heat transfer line transfers heat generated by the LED light board to the dissipater heat sink, whereby heat from the LED light board is dissipated to the exterior side of the frame by conduction through the heat transfer line and the dissipater heat sink.

15. The replacement door of claim 14, further comprising:

an accumulator heat sink coupled to a back side of the LED light board and arranged to collect heat generated by LEDs on the LED light board via conduction, wherein the accumulator heat sink is spaced apart from the dissipater heat sink, and wherein a first end of the heat transfer line is coupled to the accumulator sink and a second end of the heat transfer line is coupled to the dissipater heat sink.

16. The replacement door of claim 14, further comprising an electric power driver operatively coupled to the LED light board to power the LED light board, the power driver carried by the door frame and disposed on the interior side of the door frame.

17. The replacement door of claim 14, wherein the heat transfer line comprises a heat transfer pipe.

18. The replacement door of claim 14, wherein the dissipater heat sink comprises heat fins disposed on an exterior side of the door frame and a dissipater cap, the heat transfer line being attached to the dissipater cap.

19. The replacement door of claim 14, wherein the door frame comprises a first opening and a window covering the first opening, wherein the LED light board projects light through the window.

20. The replacement door of claim 19, wherein the window comprises at least one of a diffuser and a lens.

21. A method of retrofitting a luminaire, wherein the luminaire includes a housing defining an interior and an opening into the interior, the method comprising:

removing an existing lamp assembly from the housing;

coupling: (i) the light panel of claim 1 to the housing to cover the opening and project light to an exterior of the housing, or (ii) the replacement door of claim 15 to the housing to cover the opening and project light to the exterior of the housing.

22. The method of claim 21, wherein the existing lamp assembly comprises an HID lamp.

23. A light panel for a luminaire, comprising:

a frame having an exterior side, an interior side opposite the exterior side, a door frame, and a mount to attach the frame to a luminaire housing, wherein the mount comprises a hinge;

a lamp assembly carried by the frame, the lamp assembly including a light element arranged to project light toward the exterior side of the frame;

a dissipater heat sink carried by the frame, wherein the dissipater heat sink is spaced apart from the lamp assembly, and wherein the dissipater heat sink is exposed to the exterior side of the frame; and a heat transfer line thermally coupling the lamp assembly to the dissipater heat sink, wherein the heat transfer line transfers heat generated by the light element to the dissipater heat sink, whereby heat from the light element is dissipated to the exterior side of the frame by conduction through the heat transfer line and the dissipater heat sink.

24. A light panel for a luminaire, comprising:

a frame having an exterior side and an interior side opposite the exterior side;

a lamp assembly carried by the frame, the lamp assembly including a light element arranged to project light toward the exterior side of the frame;

a dissipater heat sink carried by the frame, wherein the dissipater heat sink is spaced apart from the lamp assembly, and wherein the dissipater heat sink is exposed to the exterior side of the frame;

a heat transfer line thermally coupling the lamp assembly to the dissipater heat sink, wherein the heat transfer line transfers heat generated by the light element to the dissipater heat sink, whereby heat from the light element is dissipated to the exterior side of the frame by conduction through the heat transfer line and the dissipater heat sink; and an accumulator heat sink coupled to the lamp assembly so as to collect heat from the light element, the accumulator having a first section and a second section, the second section being coupled to the first section, wherein the accumulator heat sink is spaced apart from the dissipater heat sink, wherein the heat transfer line is thermally coupled to the accumulator sink and is thermally coupled to the dissipater heat sink, and wherein a portion of the heat transfer line is sandwiched between the first section and the second section.

25. A light panel for a luminaire, comprising:

a frame having an exterior side, an interior side opposite the exterior side, an outer frame having a first opening and a second opening, and an inner frame coupled to the outer frame;

a lamp assembly carried by the frame, the lamp assembly including a light element arranged to project light toward the exterior side of the frame;

a dissipater heat sink carried by the frame, wherein the dissipater heat sink is spaced apart from the lamp assembly, and wherein the dissipater heat sink is exposed to the exterior side of the frame;

a heat transfer line thermally coupling the lamp assembly to the dissipater heat sink, wherein the heat transfer line transfers heat generated by the light element to the dissipater heat sink, whereby heat from the light element is dissipated to the exterior side of the frame by conduction through the heat transfer line and the dissipater heat sink; and a window captured between the outer frame and the inner frame, the window covering the first opening, wherein the light element shines through the window and the first opening, and wherein the dissipater heat sink extends through the second opening.

* * * * *